US008419308B2

(12) United States Patent
Koike et al.

(10) Patent No.: US 8,419,308 B2
(45) Date of Patent: Apr. 16, 2013

(54) DOCUMENT FASTENER AND FILE OR FOLDER

(75) Inventors: Seiichi Koike, Osaka (JP); Yukinori Fukimoto, Osaka (JP)

(73) Assignee: Sekisui Seikei, Ltd., Osaka (JP)

( * ) Notice: Subject to any disclaimer, the term of this patent is extended or adjusted under 35 U.S.C. 154(b) by 794 days.

(21) Appl. No.: 12/294,484

(22) PCT Filed: Mar. 20, 2007

(86) PCT No.: PCT/JP2007/055640

§ 371 (c)(1),
(2), (4) Date: Sep. 25, 2008

(87) PCT Pub. No.: WO2007/111195

PCT Pub. Date: Oct. 4, 2007

(65) Prior Publication Data

US 2010/0225101 A1 Sep. 9, 2010

(30) Foreign Application Priority Data

Mar. 27, 2006 (JP) ..... 2006-086757
Jan. 25, 2007 (JP) ..... 2007-015612

(51) Int. Cl.

| | |
|---|---|
| ***B42F 13/06*** | (2006.01) |
| ***B42F 13/08*** | (2006.01) |
| ***A44B 1/04*** | (2006.01) |
| ***A44B 11/25*** | (2006.01) |
| ***A44B 17/00*** | (2006.01) |
| ***B42F 1/02*** | (2006.01) |

(52) U.S. Cl.
USPC ..... 402/14; 24/67.9

(58) Field of Classification Search ..... 402/14; 24/67.9
See application file for complete search history.

(56) References Cited

U.S. PATENT DOCUMENTS 857,748 A * 6/1907 McGill ..... 402/14
(Continued)

FOREIGN PATENT DOCUMENTS

| | | | |
|---|---|---|---|
| JP | 42-19774 | Y1 | 11/1967 |
| JP | 60-88785 | U | 6/1985 |
| JP | 61-112983 | U | 7/1986 |
| JP | 1-163177 | U | 11/1989 |

(Continued)

OTHER PUBLICATIONS

International Search Report issued May 29, 2007 in corresponding International Application No. PCT/JP2007/055640.

*Primary Examiner* — Dana Ross
*Assistant Examiner* — Kyle Grabowski
(74) *Attorney, Agent, or Firm* — Wenderoth, Lind & Ponack, L.L.P.

(57) ABSTRACT

In order to newly provide a folder that facilitates insertion of a document fastener into a narrow slit and that is improved in durability by making use of a property of a document fastener whose folded state can be kept due to resin, the document fastener is so arranged to comprise a plate material (a) made of resin having a body part (11) extending longitudinally and a pair of folded pieces (12) extending from the body part (11), wherein a thickness of both end portions (14) of the plate material (a) is formed to be thinner than a thickness of other portions of the plate material (a), a boundary (13) between the body part (11) and the folded piece (12) is made to be foldable, and the folded state on the boundary (13) can be kept by making use of the properties of the resin itself.

11 Claims, 11 Drawing Sheets

U.S. PATENT DOCUMENTS

| | | | | | |
|---|---|---|---|---|---|
| 1,233,983 | A | * | 7/1917 | Clark | 402/14 |
| 2,192,701 | A | * | 3/1940 | Vogel | 402/14 |
| 2,323,393 | A | * | 7/1943 | Hartmann | 402/15 |
| 2,514,939 | A | * | 7/1950 | Crary | 402/14 |
| 2,526,975 | A | * | 10/1950 | Siegfried | 402/14 |
| 3,307,234 | A | * | 3/1967 | Murphy | 402/14 |
| 4,093,387 | A | * | 6/1978 | Jonsson | 402/14 |

FOREIGN PATENT DOCUMENTS

| | | | |
|---|---|---|---|
| JP | 03-100481 | A | 4/1991 |
| JP | 04-046944 | A | 2/1992 |
| JP | 05-013785 | A | 1/1993 |
| JP | 2003-276376 | A | 9/2003 |
| JP | 2004-106275 | A | 4/2004 |

* cited by examiner

DOCUMENT FASTENER AND FILE OR FOLDER

FIELD OF THE ART

This invention relates to a document fastener that can be used as a binder to simply bind leaves, and a file or a folder that uses the document fastener.

BACKGROUND ART

Conventionally, it has been common that this kind of the document fastener is made of metal, however, it is difficult to sort and discard the document fastener and it requires care to deal with the document fastener because its edge is sharp. Then a binder made of resin is recently conceived. For example, the binder disclosed in the patent document 1 comprises a body part extending longitudinally and a pair of folded pieces extending from the body part, and can hold leaves in a bound state by engaging a part of the folded piece with a part of the body part by making use of a concave/convex structure with forming a loop shape as a whole.

However, with the arrangement of the above-mentioned patent document 1, a mold to form a concave/convex structure is costly and it is not suitable to repeat a process of adding or removing leaves with frequency because an operation of engaging or disengaging the folded piece with or from the body part requires some degree of a knack and a force of a fingertip as well.

Meanwhile, as shown in the patent document 2, a document fastener using a strip-shaped body made of drawn polyolefin resin, more preferably a strip-shaped body made by rolling and drawing the drawn polyolefin, has been devised. Since it is possible for this kind of the document fastener to keep a folded state to a certain degree in spite of the resin because an angle to return from the folded state is small, the document fastener can effectively acts as a binder. In addition, the document fastener is easy to handle and it becomes easy to sort and discard the document fastener.

Patent document 1: Japan patent laid open number 11-78336

Patent document 2: Japan patent laid open number 2005-67027

SUMMARY OF THE INVENTION

Problems to be Solved by the Invention

However, since the document fastener disclosed in the patent document 2 is made in a homogeneously rolled and drawn state and uniform in thickness as a whole, when the document fastener is applied to a folder having a narrow slit like an individual folder, there is a problem that it is difficult to insert the end portion of the document fastener into the slit. If the end portion is formed to be thin-walled to an extent of facilitating insertion of the end portion, it is expected that this can be an obstacle to a function of keeping the folded state.

The present claimed invention is made with focusing on this problem and intends to provide a new document fastener and a file or a folder that facilitates insertion of a document fastener into a narrow slit and that is improved in durability by making use of a property of the document fastener whose folded state can be kept due to resin.

Means to Solve the Problems

In order to attain the above object, the present claimed invention takes the following measures.

More specifically, a document fastener of this invention is a document fastener comprising a plate material made of resin having a body part extending longitudinally and a pair of folded pieces extending from the body part, and is characterized by that a thickness of at least both end portions of the plate material is formed to be thinner than a thickness of other portions of the plate material and at least a boundary between the body part and the folded piece is made to be foldable, and a folded state on the boundary can be kept by making use of the properties of the resin itself without engaging the folded piece with the body part or without engaging each of the folded pieces. If the document fastener is made of resin, it might be difficult for the document fastener to be inserted into a narrow slit arranged on a folder due to its thickness. Then if both end portions of the document fastener is formed to be thin-walled, insertion becomes easy. In addition, since only the end portion is thin-walled, a function of holding the folded state would never be interfered. Furthermore, if the document fastener is made of metal and the end portion is made to be thin-walled, the end portion becomes keen, which requires careful handling. However, if the document fastener is made of resin, there is no need of such worry in handling the document fastener.

In order to improve durability, it is preferable that a rib is arranged on the boundary between the body part and the folded piece.

As a preferable embodiment represented is that the rib is arranged on a face opposite to a folded direction and a folding operation guidance part is arranged on a face of the folded direction.

In order to make it possible to effectively deal with a change of the amount of the leaves to be bound, it is represented that the folded piece is foldable further at an arbitrary position.

As another structure of the document fastener of this invention represented is a document fastener that comprises a plate material made of resin that extends longitudinally and that is foldable at an arbitrary position, and is characterized by that a thickness of both end portions of the plate material is formed to be thinner than a thickness of other portions of the plate material, a pair of portions locating on the outer side of folded portions of the plate material at a time when the plate material is folded at two portions are formed as a pair of folded pieces and a portion locating between the folded pieces is formed as a body part, and a folded state of the plate material can be kept by making use of the properties of the resin itself without engaging the folded piece with the body part or without engaging each of the folded pieces. With this structure, since the plate material is foldable at any arbitrary position, it becomes possible to change a length of the body part so as to easily deal with various pitches of the binding hole of the leaves. In addition, since the folded piece can be further folded at an arbitrary position on the distal end side of the folded portion, it becomes possible to effectively deal with variations of an amount of the interfiled leaves.

In order to further facilitate insertion of the document fastener into a slit of a folder, it is preferable that both end portions of the plate material are strengthened in hardness.

Especially, it is effective that both end portions of the plate material are thin-walled by means of rolling and strengthened in hardness as well.

As another structure to further facilitate insertion of the document fastener into a slit of a folder, a structure wherein at least both ends or vicinities of the both ends of the plate material is curved to be a concave shape in cross-section may be effectively adopted. In case that an area of the folded piece is clearly determined previously, a structure wherein the plate material is so formed that almost whole of the folded piece is curved to be a concave shape in cross-section also may be effectively adopted. Especially, in the later case, it is possible to prevent the resistance of the plate material against insertion from increasing in the middle of insertion if not only the end portion of the plate material but also a wall thickness of almost whole of the folded piece is thinner than a wall thickness of the body part. Furthermore, in the later case, it is possible to satisfy both facilitation of inserting the folded piece and assurance of a back-up state of the body part by forming a width of almost whole of the folded piece narrower than a width of the body part.

In order to make it possible to appropriately press the leaves in a folded state and to prevent the folded piece from easily restoring to an original state, it is preferable that the plate material is curved to be a concave shape in cross-section so that a surface to be an inner surface in case of folding the plate material becomes concave.

Since this invention has the above-mentioned structure, it is a matter of course that the document fastener can be used by itself, and the document fastener can be used as a file or a folder by being engaged with a front cover body of the file or the folder.

Effect of the Invention

Since this invention has the above-mentioned structure, it is possible to provide a document fastener that can effectively keep the folded state by making use of the properties of resin, that can be easily inserted into a narrow slit and that is effectively improved in durability in case of folding the same portion frequently, and a file or a folder that uses the document fastener.

DETAILED DESCRIPTION OF THE INVENTION

Figure 1:
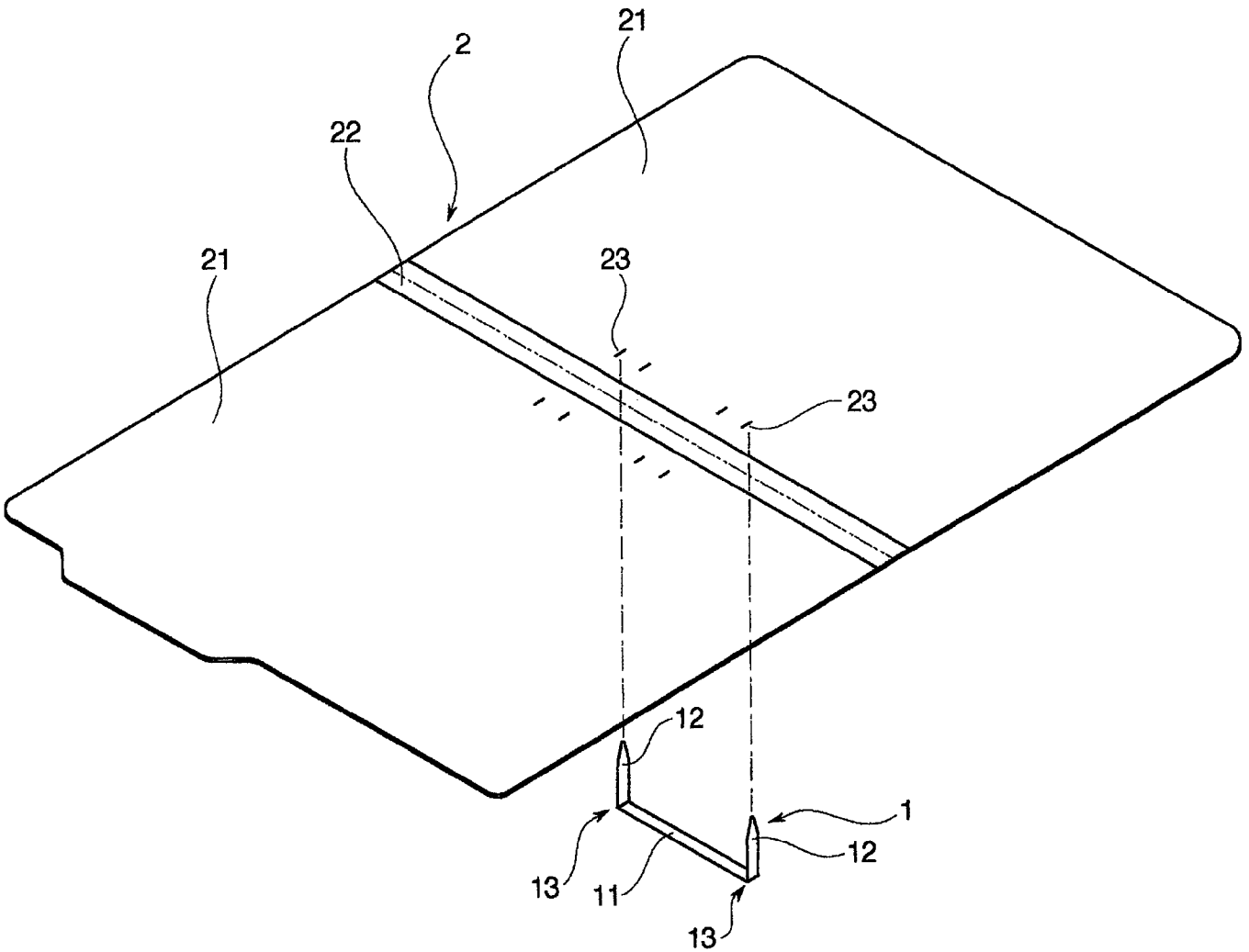
FIG. 1 is a perspective view of a folder in accordance with one embodiment of the present claimed invention.

It is a matter of course that a document fastener 1 in accordance with this embodiment shown in FIG. 1 can interfile leaves 3 by itself, and the document fastener 1 can also be used with being inserted into a folder 2 or the like.

With a concrete explanation, the document fastener 1 comprises a plate material a made of resin having a body part 11 extending longitudinally and a pair of folded pieces 12 extending from the body part 11, and is made by cutting a sheet with a press processing or the like. The sheet is obtained by rolling a polyolefin resin sheet and then drawing it, wherein rolling is a process to elongate the sheet to be thin by supplying the polyolefin resin sheet to a rolling mill roller, and drawing is a process to be conducted by the use of a roller rolling method or a zone drawing method under a heated atmosphere. With this process, the sheet becomes fibrous having a directional property in the drawing direction and laminated in a direction of its thickness so that a property of keeping a folded state is generated at a time when the sheet is folded in a direction of its thickness.

Figure 2:
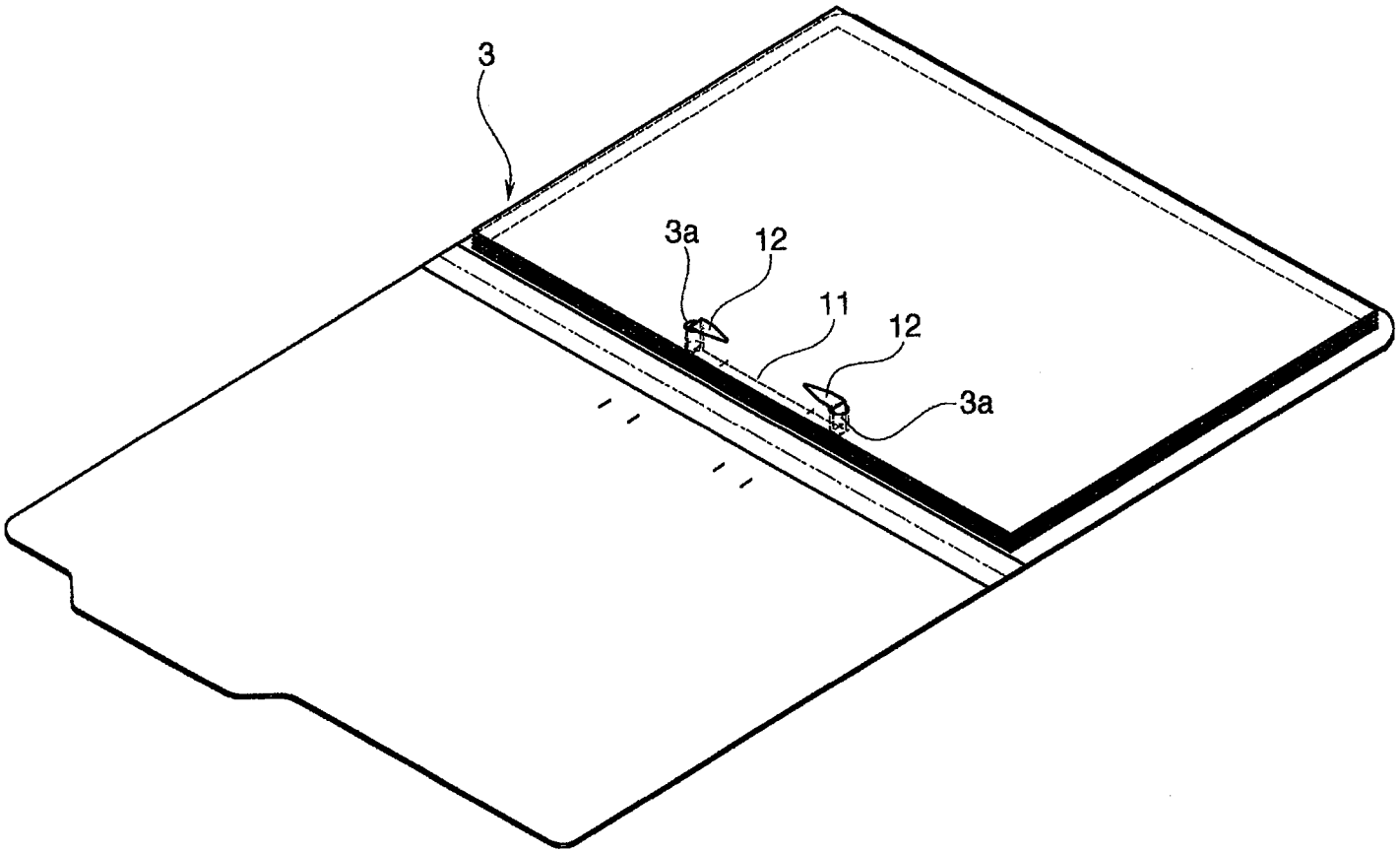
FIG. 2 is a perspective view of a state when leaves are interfiled by the folder by the use of a document fastener.
Figure 4:
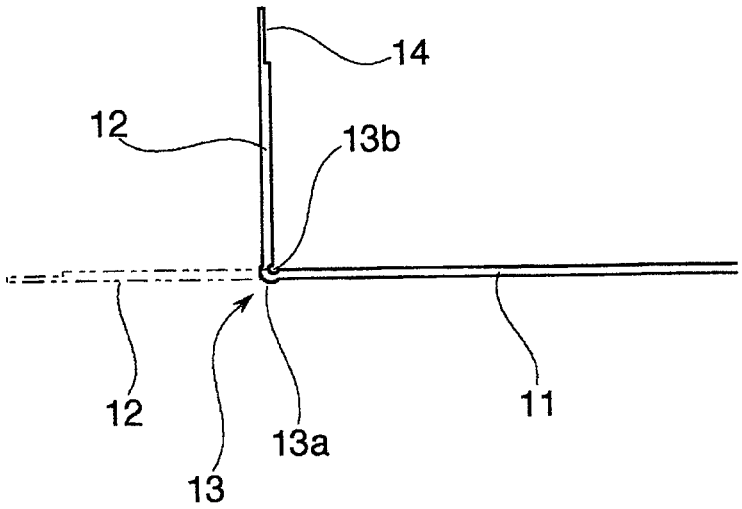
FIG. 4 is a functional explanatory view of the document fastener.
Figure 5:
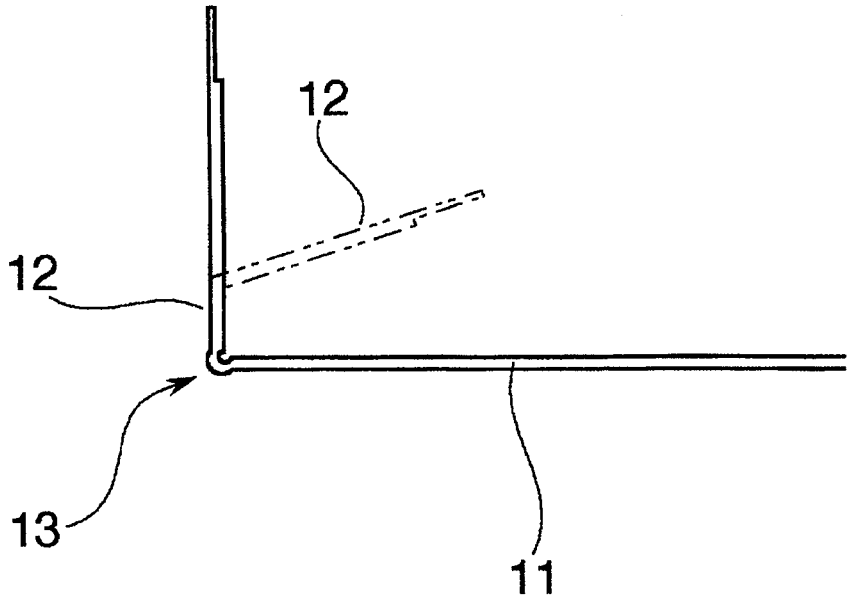
FIG. 5 is a functional explanatory view of the document fastener.

A length of the body part 11 of the plate material a obtained in this way generally corresponds to a distance between binding holes 3*a*, 3*a* of the leaves 3 shown in FIG. 2, a size of a pair of the folded pieces 12 is set to be appropriate for uprising in a direction that the folded pieces 12 are inserted into the binding holes 3*a*, 3*a* after being folded at both ends of the body part 11, and the body part 11 and the folded piece 12 are foldable on boundaries 13, 13 therebetween as shown in FIG. 4. Then the folded pieces 12, 12 are folded in a direction to approach each other (the direction may be a direction to be separated each other) after being inserted so that the leaves 3 can be interfiled with a folded state on the boundary 13 kept by making use of the properties of the resin itself without engaging the folded piece 12 with the body part 11 or without engaging each of the folded pieces 12, 12. The folded piece 12 is further foldable at any position as shown in FIG. 5 and its folded state can be kept by making use of the properties of the plate material a.

Figure 3:
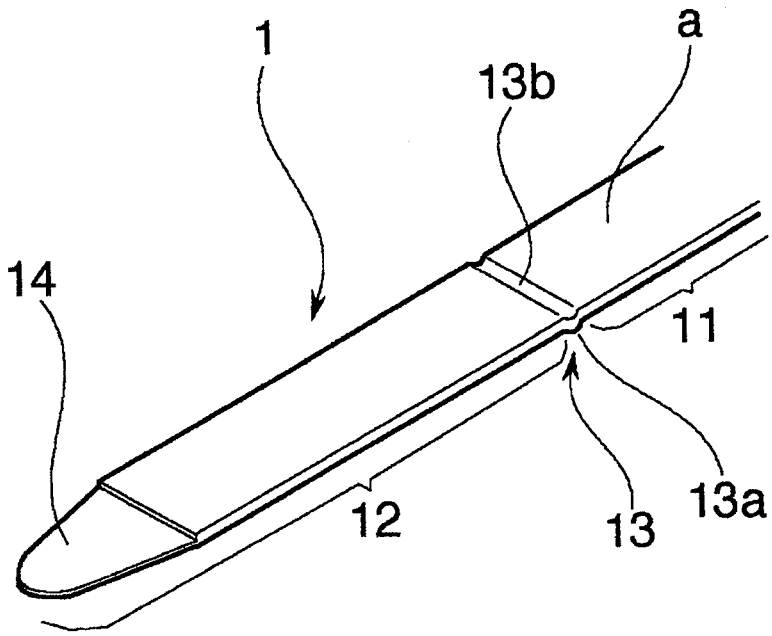
FIG. 3 is a partially enlarged perspective view of the document fastener in accordance with this embodiment.

In this embodiment, as shown in FIG. 3, a thickness of both end portions 14 of the plate material a is formed to be thinner than a thickness of other portions of the plate material a and a rib 13*a* is formed on the boundary 13 between the body part 11 and the folded piece 12. Concretely, end portions of the plate material a are rerolled locally by means of pressing or the like so as to be thinner than other portions, and the rib 13*a* is formed to bulge a little toward a face opposite to the folded direction on the boundary 13. A folding operation guidance part 13*b* to guide a position to be folded is formed on the face of the folded direction to cave in a little. The end portion 14 is in a shape of a general triangle with its apex a little rounded to facilitate insertion of the end portion 14.

A folder 2 using this document fastener 1 comprises, as shown in FIG. 1, a pair of cover bodies 21, 21 and a spine 22 connecting the cover bodies 21, 21, and narrow slits 23 are formed on a surface of each cover body 21 near the spine 22 by cutting the surface. The folder 2 can keep the leaves 3 in an interfiled state with a process of inserting the folded pieces 12 of the document fastener 1 into the slit 23 from an outside of the folder 2 so that the inserted folded pieces 12 stand on an inside of the folder 2, inserting the binding hole 3*a* of the leaves 3 shown in FIG. 2 over the folded piece 12, and then further folding the folded piece 12 at an arbitrary position.

As mentioned, the document fastener 1 comprises the plate material a made of resin having the body part 11 extending longitudinally and a pair of the folded pieces 12 extending from the body part 11, and the thickness of both end portions 14 of the plate material a is formed to be thinner than the thickness of other portions of the plate material a and the boundary 13 between the body part 11 and the folded piece 12 is made to be foldable, and the folded state on the boundary 13 can be kept by making use of the properties of the resin itself.

As mentioned, since the end portion 14 is made to be thin-walled, it becomes easy to insert the folded piece 12 into the narrow slit 23 of the folder 2, and since only the end portion 14 is made to be thin-walled and other portion is secured to have a necessary thickness, it is possible to keep an appropriate interfiled state without any problem for a mechanism to keep the folded state. In addition, if the plate material is made of metal and the end portion of the plate material is made to be thin-walled, the end portion becomes keen, thereby requiring careful handling. However, since the document fastener 1 is made of resin, there is no need of such worry in handling the document fastener 1, which makes it possible to use the fastener 1 easily and securely.

Especially, since the boundary 13 between the body part 11 and the folded piece 12 is frequently folded every time the leaves 3 are added or removed, there is a concern that the document fastener 1 becomes fragile in a short period of time and the keeping force is degraded although the document fastener 1 is made of resin. However, if the rib 13*a* is formed on the boundary 13 between the body part 11 and the folded piece 12 as in this embodiment, it is possible to keep a shape keeping function by suppressing progress of fatigue, thereby effectively elongating a product life cycle.

In addition, since the rib 13*a* is arranged on the face opposite to the folded direction and the holding operation guidance part 13*b* is arranged on the face of the folded direction, the holding operation guidance part 13*b* contributes to prevention of difficulty in folding the plate material a because of the rib 13*a*, and the rib 13*a* contributes to prevention of degradation of the shape keeping properties because of the holding operation guidance part 13*b*.

In addition, since the folded piece 12 is made to be further foldable at any arbitrary position, it is possible to effectively deal with change in an amount of interfiled leaves 3.

Furthermore, if the hardness of the plate material a is about a degree with which the plate material a can be further folded at any arbitrary position uniformly along the longitudinal direction, there might be a case that the end portion 14 is broken because the end portion 14 is thin-walled, resulting in failing insertion of the end portion 14 into the slit 23. However, in this embodiment, since both end portions 14 of the plate material a are provided with the rolling process and not only the thin-walled effect but also increased hardness can be expected due to the rolling process, it is possible to effectively prevent the trouble in inserting the end portion 14 into the slit 23.

With the above-mentioned structure, it is possible to utilize the folder 2 user-friendly by engaging the document fastener 1 with the cover body 21 of the folder 2.

Each concrete arrangement is not limited to the above-mentioned embodiment.

Figure 6:
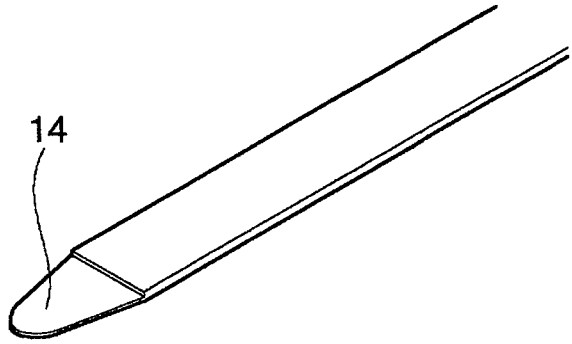
FIG. 6 is a partially enlarged perspective view of a document fastener in accordance with another embodiment of the present claimed invention.
Figure 7:
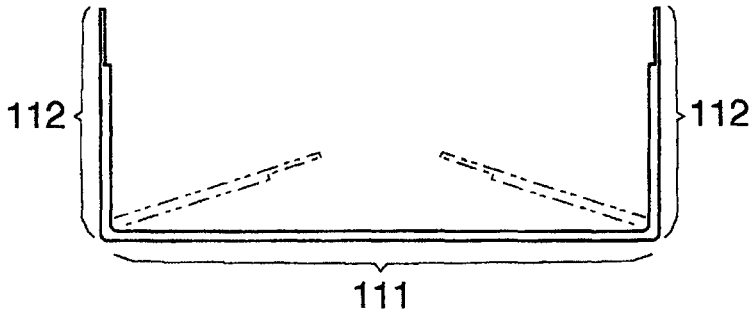
FIG. 7 is a functional explanatory view of the document fastener.
Figure 7:
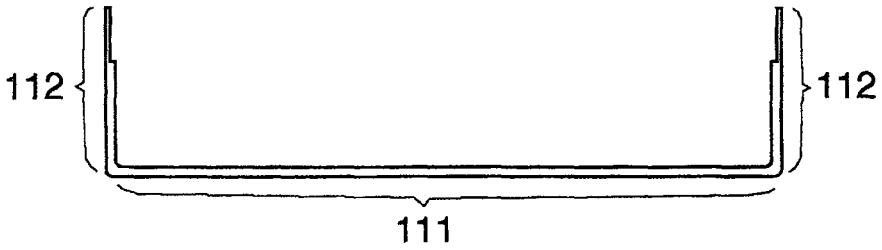

For example, as an example of a document fastener wherein an area of a body part or a folded piece is not determined, it may comprise, as shown in FIG. 6, a plate material a made of resin that extends longitudinally and that is foldable at an arbitrary position like the above-mentioned embodiment, wherein a thickness of both end portions 14 of the plate material a may be formed to be thinner than a thickness of other portions of the plate material a, portions locating on the outer side of folded portions of the plate material a at a time when the plate material a is folded at two portions may be set as a pair of folded pieces 112, 112 and a portion locating between the folded pieces 112, 112, may be set as a body part 111, and a folded state of the plate material a can be kept by making use of the properties of the resin itself.

With this structure, since the plate material a is foldable at any arbitrary position, it becomes possible to change a length of the body part 111 so as to easily deal with various pitches of the binding holes 3*a* of the leaves 3. In addition, since the folded piece 112 can be further folded at an arbitrary position, it becomes possible to effectively deal with variations of an amount of the interfiled leaves 3.

Figure 8:
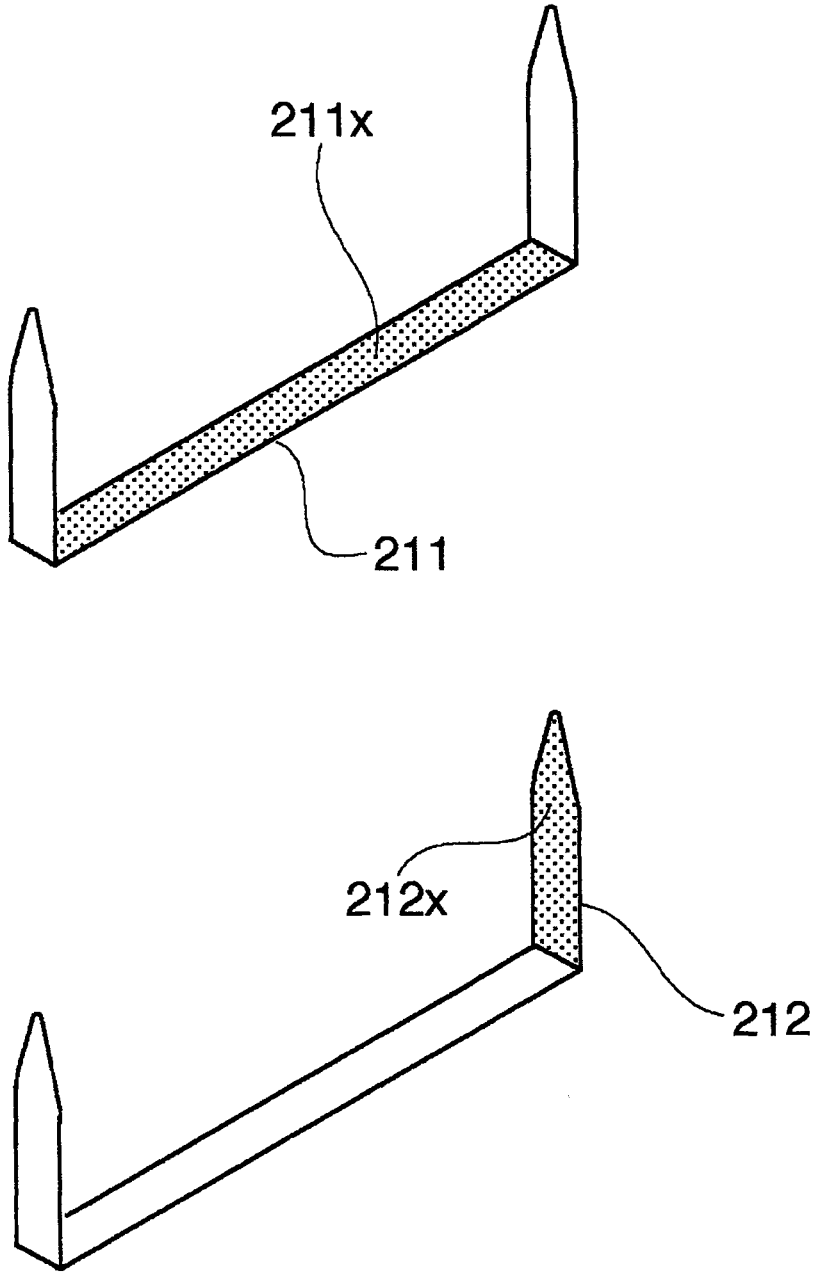
FIG. 8 is a functional explanatory view of the document fastener.

In addition, as shown in FIG. 8, if an adhesive portion 211*x* is formed inside of the body part 211, it becomes possible to improve a degree of fixing the body part 211 to a reverse side of the cover body 21. If an adhesive portion 212*x* is formed inside of the folded piece 212, it becomes possible to improve a degree of fixing the folded piece 212 to a surface of the leaves 3.

Figure 9:
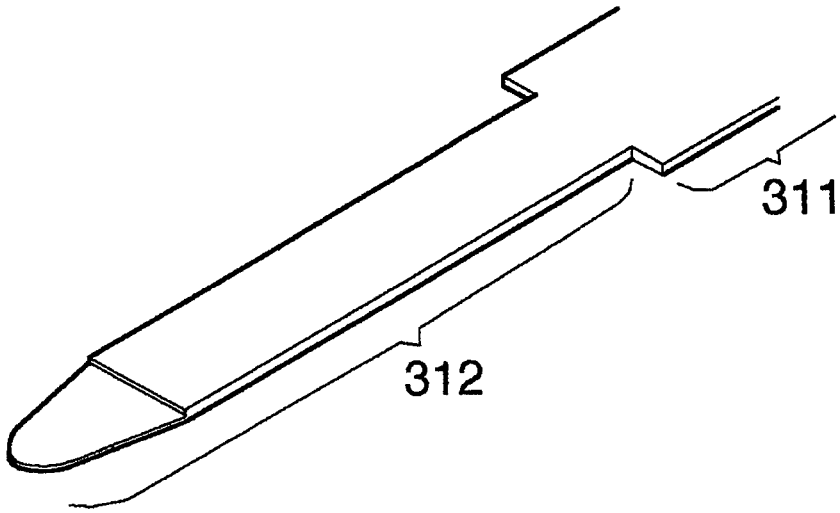
FIG. 9 is a view showing a modified form of the document fastener.

Furthermore, an arrangement wherein a body part 311 is formed to be wider than a folded piece 312 as shown in FIG. 9 so that the folder 2 or the leaves 3 smoothly fits the body part 311 will also be effective.

In addition, as one of the arrangements other than the above to realize a thin-walled end portion without providing a rolling process, a document fastener 401 as shown in FIG. 10 through FIG. 14 also becomes effective to adopt.

It is a matter of course that the document fastener 401 can interfile the leaves 3 by itself, and the document fastener 401 can also be used with being inserted into a folder 2 or the like.

More specifically, the document fastener 401 comprises a plate material a made of resin, the same as that of the document fastener 1 in the above-mentioned embodiment, having a body part 411 extending longitudinally and a pair of folded pieces 412 extending from the body part 411, and is made by cutting a sheet with a press processing or the like. An end portion 414 is in a shape of a general triangle with its apex a little rounded to facilitate insertion of the end portion 414. A length of the body part 411 of the plate material a generally corresponds to a distance between binding holes 3*a*, 3*a* shown in FIG. 11, and a size of a pair of the folded pieces 412 is set to be appropriate for uprising in a direction that the folded piece 412 is inserted into the binding holes 3*a*, 3*a* after being folded from both ends of the body part 411, and the body part 411 and the folded piece 412 are foldable on boundaries 413, 413 therebetween. Then the folded pieces 412, 412 are folded in a direction to approach each other after being inserted so that the leaves 3 can be interfiled with a folded state on the boundary 413 held by making use of the properties of the resin itself without engaging the folded piece 412 with the body part 411 or without engaging each of the folded pieces 412, 412. The folded piece 412 is further foldable at any position tailored to a thickness of a bunch of the leaves 3 and its folded state can be kept by making use of the properties of the plate material a.

Figure 12:
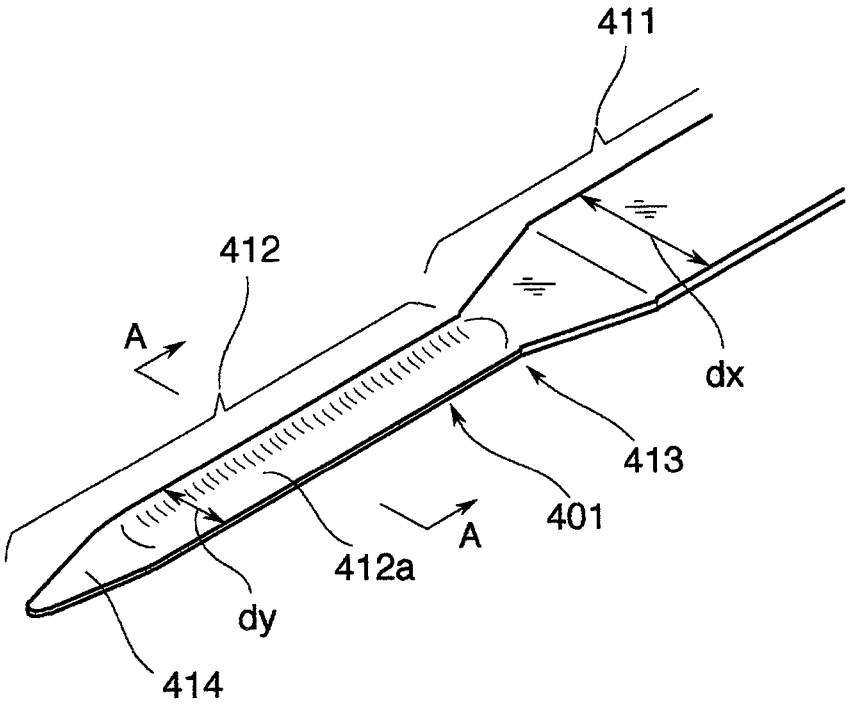
FIG. 12 is a partially perspective view of the document fastener in accordance with this embodiment.
Figure 13:
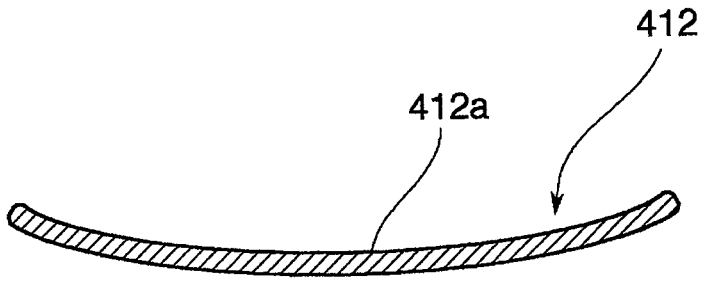
FIG. 13 is a cross-sectional view taken along the A-A line in FIG. 2.

In addition, in this embodiment, at a time of a process of cutting the sheet by means of pressing, or before or after the process, a convex cylindrical die and a concave cylindrical die, not shown in drawings, are arranged to hold almost all of the folded piece 412 of the plate material a from upside and downside (concretely, from a distal end except for an end portion 414 having a shape of a general triangle to the neighborhood of the boundary 413 between the body part 411 and the folded piece 412 as shown in FIG. 12) and the folded piece 412 is press-molded between the convex cylindrical die and the concave cylindrical die so as to form a curved surface 412*a* whose cross-section is a concave wherein a face locating inside in case that the plate material a is folded becomes concave. The document fastener in this embodiment is so arranged that a thickness of almost all of the folded piece 412 is formed to be thinner than a thickness of the body part 411, and a width dy of almost all of the folded piece 412 is formed to be narrower than a width dx of the body part 411, and the folded piece 412 and the body part 411 are connected with gradually changing a width of a portion near the boundary 413.

Figure 10:
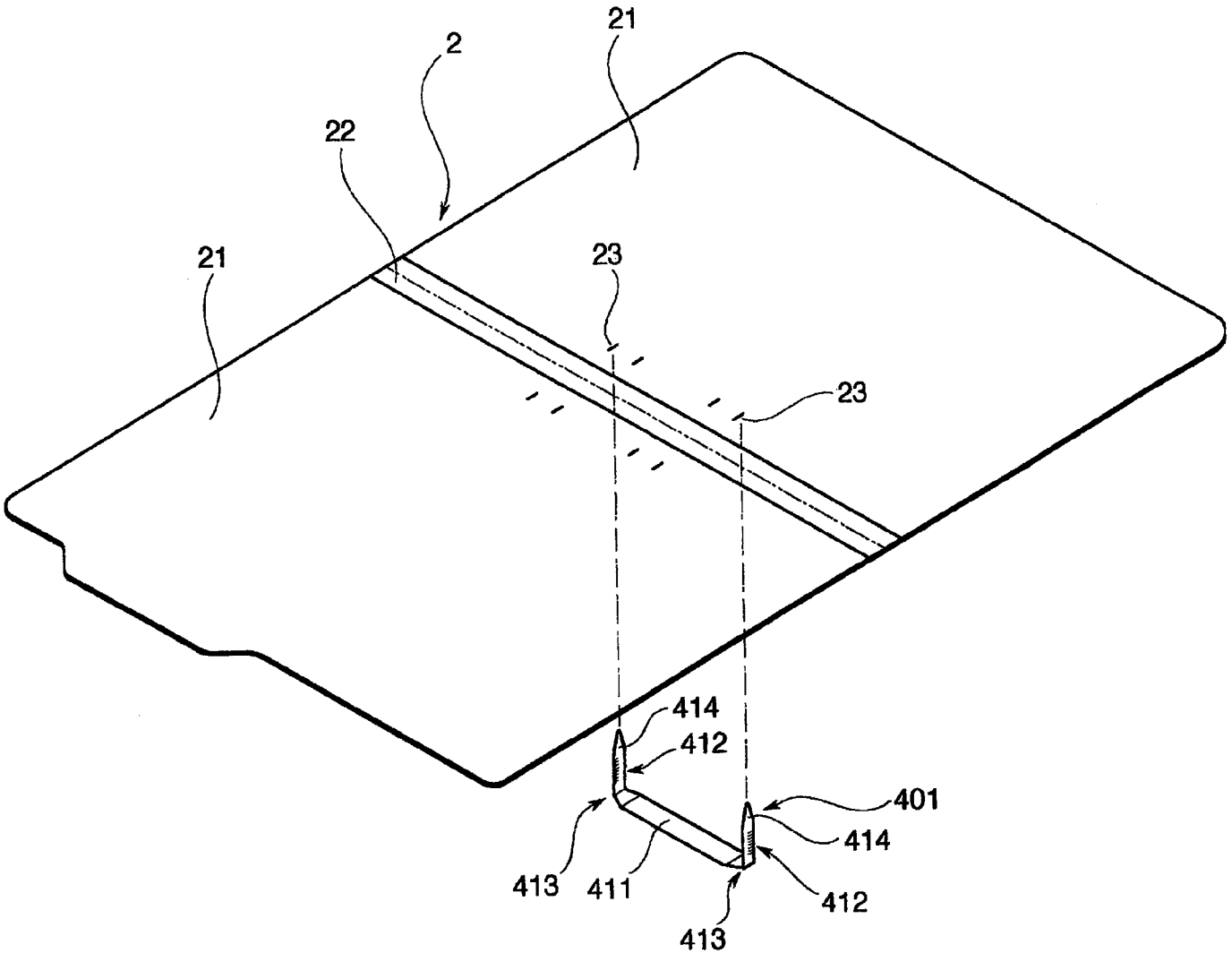
FIG. 10 is a perspective view of a folder in accordance with an embodiment other than the above-mentioned embodiment of the present claimed invention.
Figure 14:
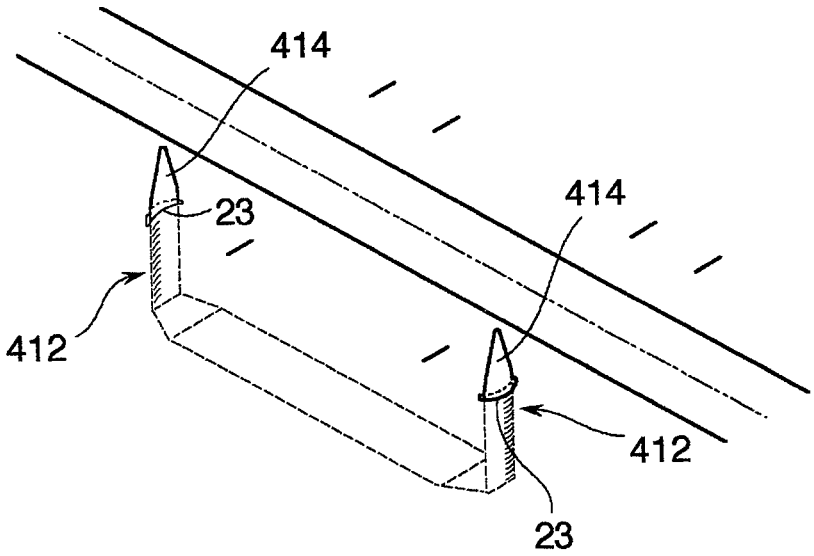
FIG. 14 is a perspective view showing a state in a middle of inserting the document fastener into the folder.

When an end portion 414 of the document fastener 401 having the above structure is pushed against and inserted into the slit 23 of the folder 2 shown in FIG. 10, the end portion 414 of the folded piece 412 first enters into the slit 23 as shown in FIG. 14, and then a portion locating closer to a proximal end from the end portion 414 enters into the slit 23 with deforming or pushing to open the slit 23 in the same shape as that of the curved cross-section of the folded piece 412. At this time, since whole of the folded piece 412 including the end portion 414 is made to be thin-walled, it is possible to easily insert the folded piece 412 into the narrow slit 23. In addition, since almost whole of the folded piece 412 is curved in its cross-section so that the folded piece 412 is in a shape that is tough against a force applied to a longitudinal direction, the folded piece 412 straightly enters into the slit 23 without being buckled even if a relatively strong pushing force is applied thereto.

Figure 11:
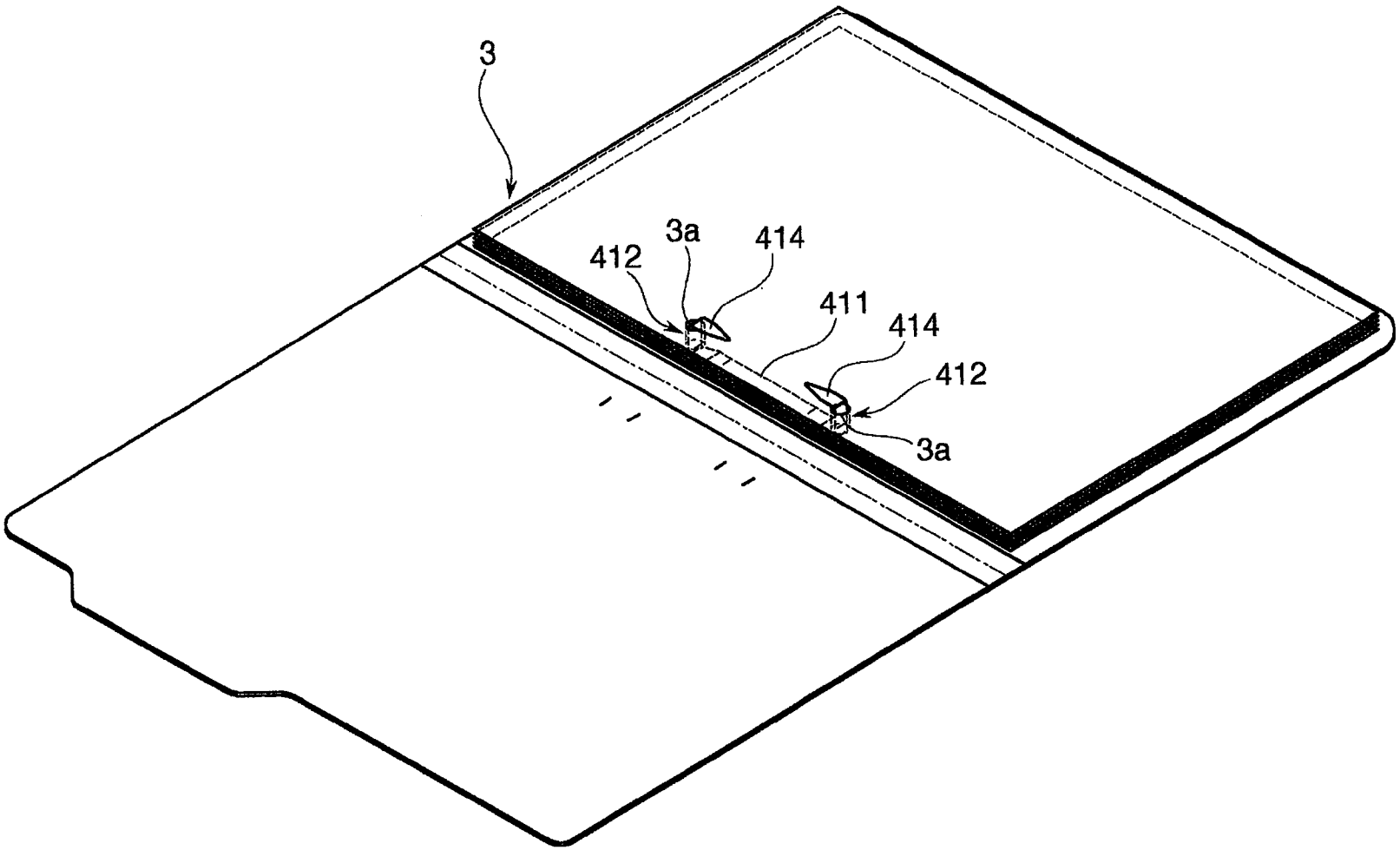
FIG. 11 is a perspective view of a state when leaves are interfiled by the folder by the use of a document fastener.

Meanwhile, even though the cross section of the folded piece 412 is curved, the folded piece 412 can be folded relatively easily when a force is applied to a direction in a folded direction. And since a face locating inside when the folded piece 412 is folded is concave in cross section, a pair of the folded pieces 412, 412 can be folded to approach each other as shown in FIG. 11 with locally releasing a curved shape only at the folded portion locating closer to the distal end from the boundary portion 413 including the boundary portion 413. In addition, if the face locating inside when the folded piece 412 is folded is made to be concave, it is possible for the folded pieces 412 to press the leaves 3 by making use of a pair of side edges of the folded pieces 412 more accurately than a case of a reverse structure, more specifically, the face locating outside when the folded piece 412 is folded is made to be concave. Furthermore, since a portion where a curved state is released due to a folding operation is limited to a narrow range, it is possible to prevent a tendency that the folded piece 412 tries to stand up to be restored to the original shape due to a repulsive force from the resin as much as possible.

The cross section of the folded piece 412 including the end portion 414 in FIG. 10 through FIG. 14 may be curved in a concave shape, or the end portion 414 alone can be curved to be concave in cross-section. In case of the later, it is preferable that a relatively wide area along a longitudinal direction from the distal end of the folded piece 412 is considered to be the end portion. In addition, a structure to curve the cross section in a concave shape can be also used for a structure shown in FIG. 1 through FIG. 5 to reinforce hardness of the end portion by means of a rolling process.

Other arrangement may be variously modified without departing from the spirit of the invention, and it is a matter of course that the same effect can be obtained if this document fastener is applied to a file.

The invention claimed is:

1. A document fastener comprising:

a plate material made of resin having a body extending in a longitudinal direction and a pair of foldable pieces located at end portions of the body, wherein said plate material is obtained by rolling a polyorefin resin sheet and then drawing the polyorefin resin sheet, said plate material having a width in a transverse direction to the longitudinal direction, wherein tip portions of the foldable pieces are each formed by rolling so as to have a thickness that is less than a thickness of other portions of the foldable pieces, and so as to have a hardness which is greater than that of other portions of the foldable pieces, wherein at least a portion of each foldable piece is curved so as to have a concave shape in cross-section, wherein a boundary between the body part and each foldable piece is made to be foldable, wherein said plate material has a property of maintaining a folded state at a time when the plate material is folded in a direction of its thickness, wherein a folded state on each boundary can be held by making use of the properties of the resin itself without engaging either foldable piece with the body part and without engaging each of the foldable pieces with each other, wherein a length of said plate material in the longitudinal direction is greater than the width in the transverse direction, and wherein the width in the transverse direction is greater than the thickness of the plate material.

2. The document fastener described in claim 1, wherein ribs are arranged on the boundaries between the body and the foldable pieces.

3. The document fastener described in claim 2, wherein the ribs are arranged on a face opposite to a folding direction, and a folding operation guidance part is arranged on a face which faces the folding direction.

4. The document fastener described in claim 3, wherein each foldable piece is foldable further at an arbitrary position.

5. The document fastener described in claim 1, wherein the plate material is so formed that each foldable piece is almost entirely curved to have a concave shape in cross-section.

6. The document fastener described in claim 5, wherein the plate material is so formed that almost an entire width of each foldable piece is narrower than a width of the body part.

7. The document fastener described in claim 1, wherein the plate material is curved to have a concave shape in cross-section so that a surface to be an inner surface in case of folding the plate material becomes concave.

8. The document fastener described in claim 1, wherein the tip portions are tapered.

9. A document fastener comprising:

a plate material made of resin that extends in a longitudinal direction and that is foldable at an arbitrary position, wherein said plate material is obtained by rolling a polyorefin resin sheet and then drawing the polyorefin resin sheet, said plate material having a width in a transverse direction to the longitudinal direction, wherein a pair of portions located on outer sides of foldable portions of the plate material at a time when the plate material is folded at two portions are formed as a pair of foldable pieces, and a portion located between the foldable pieces is formed as a body part, wherein tip portions of the foldable pieces are each formed by rolling so as to have a thickness that is less than a thickness of other portions of the foldable pieces, and so as to have a hardness which is greater than that of other portions of the foldable pieces, wherein at least a portion of each foldable piece is curved so as to have a concave shape in cross-section, wherein a folded state of the plate material can be held by making use of the properties of the resin itself without engaging either foldable piece with the body part and without engaging each of the foldable pieces with each other, wherein a length of said plate material in the longitudinal direction is greater than the width in the transverse direction, wherein the width in the transverse direction is greater than the thickness of the plate material, and wherein said plate material has a property of maintaining a folded state at a time when the plate material is folded in a direction of its thickness.

10. The document fastener described in claim 9, wherein the tip portions are tapered.

11. A file or a folder comprising:

a front cover body; and the document fastener described in claim 1 engaged with the front cover body.

* * * * *